United States Patent [19]

Katzer et al.

[11] Patent Number: 4,905,903

[45] Date of Patent: Mar. 6, 1990

[54] SPRINKLER

[75] Inventors: Johann Katzer, Neu-Ulm; Christian Stephany, Ulm-Wiblingen; Willi Hepperle, Westerstetten, all of Fed. Rep. of Germany

[73] Assignee: Gardena Kress & Kastner GmbH, Fed. Rep. of Germany

[21] Appl. No.: 225,286

[22] Filed: Jul. 28, 1988

[30] Foreign Application Priority Data

Jul. 31, 1987 [DE] Fed. Rep. of Germany ..... 3725384

[51] Int. Cl.[4] ..... B05B 3/06; A62C 3/00

[52] U.S. Cl. ..... 239/246; 239/256; 239/391; 239/436

[58] Field of Search ..... 239/246, 256, 253, 257, 239/436, 251, 391, 397, 442, 394, 443, 436

[56] References Cited

U.S. PATENT DOCUMENTS

| | | | |
|---|---|---|---|
| 2,624,625 | 1/1953 | Magos et al. | 239/436 |
| 2,769,667 | 11/1956 | Spender | 239/253 |
| 3,051,183 | 8/1962 | Jacobs | 239/257 X |
| 3,064,665 | 11/1962 | Martinak | 239/246 X |
| 3,081,950 | 3/1963 | Rinkewich | 239/436 X |
| 3,982,698 | 9/1976 | Anderson | 239/436 X |
| 4,510,784 | 4/1985 | Hsu | 239/436 X |

*Primary Examiner*—Andres Kashnikow
*Assistant Examiner*—Kevin P. Weldon
*Attorney, Agent, or Firm*—Steele, Gould, Fried

[57] ABSTRACT

A rotor (11) is provided with a plurality of uniformly circumferentially distributed, radially projecting, tubular nozzle supports (3), which in each case carry a nozzle head (4) at the end. Each nozzle head (4) is circumferentially provided with several differently constructed nozzle units (6, 7, 8) with in each case a plurality of discharge nozzles (9) and in the manner of a turret indexing head is so rotatable about a control axis (30) with respect to the associated nozzle carrier (3), that any selected one of its nozzle units (6, 7, 8) can be brought into the operating position connected to a water supply. This offers numerous possibilities for adjusting the sprinkling pattern.

36 Claims, 3 Drawing Sheets

SPRINKLER

BACKGROUND OF THE INVENTION

1. Field of the Invention

The invention relates to a sprinkler comprising a nozzle support having a nozzle unit.

2. Prior Art

In the case of sprinklers there is a need to be able to choose the sprinkling width and also the specific sprinkling density, so that the particular different requirements can be met. Hitherto adjustment has taken place by regulating the water feed quantity, by adjusting the angle or by similar measures, but the results have not been satisfactory in all cases.

SUMMARY OF THE INVENTION

An object of the present invention is to provide a sprinkler of the aforementioned type, which in simple manner permits the setting of even widely varying sprinkling patterns, for example between a small and an extremely large sprinkling width or between a small and a large sprinkling density.

According to the invention, this object is achieved by a sprinkler in which for at least one nozzle support are provided at least two separate, different nozzle units, whereof at least one can as desired, be in the operating position and outside the operating position can be transferred into an inoperative position. According to the invention it is possible to use two different nozzle units designed for different sprinkling patterns, it being conceivable to construct the nozzle units in interchangeable manner e.g. by mounting on the nozzle support, so that the nozzle unit which is not required in a particular situation can be stored separately from the nozzle support, e.g. in a mounting on the base part. However, it is also possible to leave at least one nozzle unit constantly on the nozzle support, optionally in an operating position and preferably to modify the sprinkling pattern by connecting at least one further nozzle unit.

However, according to a particularly advantageous embodiment of the invention in addition thereto and in particular instead thereof all the nozzle units provided for use on the associated nozzle support are so mounted on the latter that in a simple movement they can be transferred separately, or optionally pairwise, or optionally in a plurality into an operating position, where they are connected to the water supply. There can be two, four, five, six or more nozzle units, but preferably there are three nozzle units uniformly distributed about an adjusting axis, so that in the manner of indexing a turret by rotating the nozzle head or tip any of the nozzle units present can readily be brought into the operating position and consequently the relevant sprinkling pattern can be set. Appropriately per nozzle unit there are several discharge nozzles arranged successively in a row e.g. parallel to the adjusting axis, so that from the differently inclined discharge nozzles of the nozzle unit a type of flat water curtain can be discharged. However, it is also conceivable to provide the nozzles on an upright or approximately vertically arranged nozzle support. However, in most cases there is a horizontal arrangement of the nozzle support, so that the nozzle unit in the operating position is located on the top of the nozzle support and the discharge nozzles of the nozzle row are superimposed in succession in the associated orientation.

If there are several nozzle supports with separate nozzle heads and for at least two or more or all the nozzle supports, different nozzle units are provided in accordance with the present invention, then through the combination of the separate nozzle units brought into the operating position numerous variation possibilities are provided and even a very fine adjustment of the sprinkling pattern is possible within a very large setting range. This can be further improved in that the particular nozzle unit in the operating position can be positionally changed within a limited range with respect to the nozzle support, which can be particularly simply achieved if the nozzle unit can be adjusted over a limited arc angle about the adjusting axis without interrupting the water supply and is only cut off from the water supply on exceeding this arc angle. The arrangement can also be such that the water supply per nozzle head, i.e. with respect to all the nozzle units thereof can be cut off, which can e.g. be achieved in that in a central position between two operating positions of two adjacent nozzle units, the water supply to both of these nozzle units is interrupted. By cutting off or stopping individual nozzle heads, there is a considerable increase in the number of possible variations with respect to the setting of the sprinkling pattern. This also applies if each nozzle unit is formed by an interchangeable nozzle body and all the nozzle bodies are fixed with identical fixing means to the nozzle head, because in this case more nozzle units are available than are provided on the nozzle heads.

Although it is conceivable to arrange the nozzle support or supports in fixed manner with respect to the base part e.g. formed by a tie rod, bracket, cantilever, etc., a particularly advantageous construction is obtained if at least one and in particular all the nozzle supports are jointly provided on a rotor, which rotates about a rotor axis by means of a suitable drive device during the operation of the sprinkler, so that a more uniform sprinkling pattern is obtained over a relatively large sprinkling surface. Instead of this or in addition thereto it is also possible to provide other movable mounting supports for the nozzle support or supports, e.g. performing reciprocating movements. The drive for said movement is appropriately provided by hydraulic power by means of the pressurized water supplied to the sprinkler. Although a separate hydraulic motor, such as a turbine is possible, there is no need for this if at least one nozzle unit can be brought into an inclined driving position such that it simultaneously acts as a discharge device and a drive nozzle, i.e. the driving power for the nozzle support is a reaction force of the water discharged from the nozzle unit. In this case the sprinkler can be given a very simple design and also by a different setting of the nozzle unit in the operating position, the driving force can be adjusted between a maximum value and a preferably zero minimum value, so that by varying the speed of movement of the nozzle support, it is possible to further increase the number of variations for the sprinkling pattern.

In a preferred embodiment of the invention there are three nozzle supports with identical nozzle heads arranged so as to project radially from an axis or the rotor axis, which are uniformly distributed about the latter and project to the same extent or are identically constructed, each nozzle head having three nozzle units with in each case a different number of discharge nozzles. The number of discharge nozzle per nozzle unit is appropriately between approximately 1 or 2 and 10, preferably between 4 and 6, the discharge nozzles per nozzle unit having different nozzle widths and/or different nozzle inclination angles, particularly in such a way that the outermost discharge nozzle of the nozzle unit has the shallowest inclination angle or the greatest nozzle width and the innermost discharge nozzle has the minimum nozzle width or the minimum inclination angle, namely is e.g. approximately vertically oriented. The intermediate discharge nozzles can have increasing angles of inclination towards the outermost discharge nozzle. The arrangement is also appropriately such that the outermost discharge nozzles of all the nozzle units have approximately identical spacings with respect to one end of the nozzle carrier or the rotor axis, so that as a function of the number of discharge nozzles the innermost discharge nozzles of the nozzle units have different corresponding spacings. The distances between adjacent discharge nozzles are appropriately the same in all the nozzle units.

These and further features of preferred developments of the invention can be gathered, apart from the claims, from the description and drawings, whereby the individual features can be realized singly or in the form of subcombinations in an embodiment of the invention and in other fields and can constitute advantageous, independently protectable constructions, for which protection is hereby claimed.

BRIEF DESCRIPTION OF THE DRAWINGS

An exemplary embodiment of the invention is described hereinafter relative to the drawings, wherein are shown.

DETAILED DESCRIPTION OF THE PREFERRED EMBODIMENTS

Figure 1:
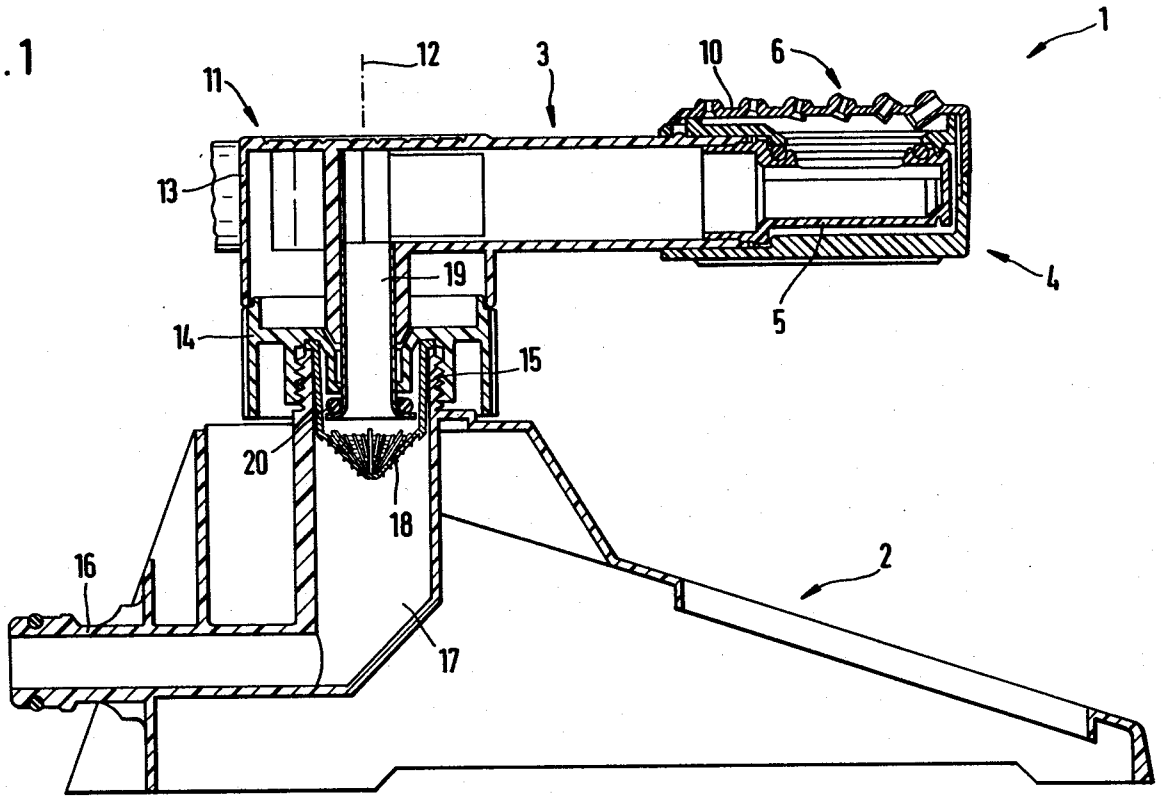
FIG. 1: An inventive sprinkler in vertical section.

The sprinkler 1 according to FIGS. 1 to 5 has a flat, console-like inclined and in plan view substantially trapezoidal base part 2, three nozzle supports or carriers 3 located radially on its top surface, which are horizontal or approximately parallel to the standing surface of the base part 2, at the end of each nozzle support a nozzle head or tip 4 mounted so as to rotate about the central axis of the associated nozzle support 3 on a bearing shaft 5 and on each nozzle head 4 three circumferentially uniformly distributed, but differently constructed nozzle units 6, 7, 8 with in each case several discharge nozzles 9 located on a common axial plane of nozzle support 3 and leading into the open, each nozzle unit 6, 7, 8 being formed by a nozzle body 10, which is fixed as a separate, angular ledge-like assembly to the sleeve or socket-like nozzle head 4 by means of a snap or plug-in connection.

The nozzle supports 3 form a component of a rotor 11 rotatable about a rotor axis 12 at right angles to the standing surface of base part 2 or approximately vertical, mounted on base part 2 and located on its top surface close to the trapezium apex. Rotor 11 has a socket-like, downwardly open hub 13 with which the tubular nozzle support 3 is constructed in one piece in such a way that it projects radially from the casing of hub 13. It is also conceivable to provide a single nozzle support 3 with a nozzle head 4. Hub 13 is rotatably mounted on a bearing socket 14 constructed in the manner of a cap nut with a central, tubular support stud arranged in substantially spaced manner within its casing and connected at an angle to the inner ends of the nozzle support 3. It is screwed onto the external thread of a connecting piece projecting over the top of the remaining base part 2. In the interior of base part 2, the tubular connecting piece 15 passes into an angularly connected connection 16 projecting rearwards over the apex surface of the trapezium shape and which is constructed for the connection of a water hose coupling. Connecting piece 15, connection 16, the support stud and the nozzle support 3 including the associated bearing shaft together form a water supply 17 for the associated nozzle head.

Rotor 11, rotatably mounted by means of an axial sliding bearing, has at the lower end of the support stud a frustum-shaped bearing surface with which is associated in the bearing socket 14 a corresponding frustum-shaped bearing recess. In the support stud is inserted a bearing sleeve 19 having on the face of the bearing surface 14 remote from the support stud a collar for receiving a bearing ring 20 also suitable for sealing purposes and with which is associated with axial clearance on its side facing the support stud a circular surface of the bearing socket 14 as a bearing surface. The described mounting is essentially located within the projecting part of the connecting piece 15. With the bearing socket 14 a screen socket 18 is braced against the upper face of the connecting piece 15 of the collar and its screen body is located in the water supply 17 in the flow direction upstream of the mounting support and immediately adjacent to the collar of the bearing sleeve 19.

All parts can be made from plastic or plastic moldings, but appropriately the bearing sleeve 19 is made in thin-walled manner from a stainless metal. As a result of the described construction a compact, easy action and dirt-protected mounting support for the rotor 11 is obtained.

The bearing shaft 5 forms at the free end a frontally closed extension of the tubular nozzle support 3 and is rigidly fixed thereto by plugging with an end socket 21. However, the operating position of the nozzle unit can be influenced by rotation or by a displaced arrangement of the bearing shaft 5 about the central axis of nozzle support 3 in the manner of a basic adjustment. The projecting part of the bearing shaft 5 has an external width, which at the most is as large as the internal width of the nozzle support 3 and is in particular slightly smaller.

In the casing of the bearing shaft 5 is provided an elongated water passage opening 22 extending over most of the length thereof and with which is associated in the casing of the nozzle head 4 for each nozzle unit 6 an approximately equally large or slightly longer and slightly narrower water inlet opening 23, in such a way that in at least one operating position of the particular nozzle unit 6, its inlet opening 23 is substantially congruent to the passage opening 22. The water inlet opening 23 is directly connected to a distribution chamber 24 projecting over the front and rear end or which is longer than said opening and which is bounded at the side opposite to opening 23 by the associated nozzle body 10 or on said side has the inner openings of the discharge nozzles 9.

At least one seal 25, preferably in the form of an O-ring, is provided around the intercommunicating passage and inlet openings 22, 23 for reciprocal sealing between the bearing shaft 5 and nozzle head 4. In order that only a single seal 25 is required for all the nozzle units 6, 7, 8, it is arranged on the bearing shaft 5 and namely on the outer circumference thereof in an annular clearance surrounding the passage opening 22, so that the shoulder surface of the nozzle head 4 surrounding the inlet opening 23 engages thereon with a predetermined sealing pressure. For as long as the inlet opening 23 is within seal 25, the associated nozzle unit is connected to the water supply with full power.

The nozzle body 10 has a trapezoidal profile with open base side, there being projecting connector links on the profile legs and they can be inserted in slot-like receptacles 26 of nozzle head 4 provided on either side of the distribution chamber 24 in such a way that the profile legs of the nozzle body 10 engage with their longitudinal edges on nozzle head 4 and form with their outer faces a substantially continuous extension of the associated outer faces of nozzle head 4. On the front or outer end, each nozzle body 10 has an end leg at right angles to its discharge nozzles 9 and which is located approximately in the plane of the free end of nozzle head 4.

Nozzle head 4 has a sleeve-like construction and at its free or outer end is frontally closed in the manner of a plug-in socket and which by means of a bearing end 27 with a widened internal diameter and remote from its end wall is rotatably mounted on the outer circumference of the outer end of nozzle support 3. Close to the free end of nozzle support 3, the internal width of the nozzle head 4 is reduced, but over most of the length of bearing shaft 5 is supported with respect thereto in contact-free manner or solely via seal 25. In the vicinity of the free end of bearing shaft 5, the latter and the nozzle head 4 can engage in one another outside seal 25 by means of a further mounting support or at least an axial securing means. Immediately adjacent to the end an annular clearance 28 is appropriately provided on the outer circumference of bearing shaft 5 and in it engages a cam 29 of nozzle head 4 located adjacent to the associated end of inlet opening 23.

In the casing of the nozzle head 4, which has a polygonal external cross-section approximately corresponding to the number of nozzle units 6, 7, 8 and the latter in the vicinity of the cross-section corners, is provided a number of openings corresponding to the number of nozzle units 6, 7, 8 and these form the inlet openings 23. In these areas the casing of the nozzle head 4 is also provided on the external circumference with a depression bounded over the entire circumference and which approximately extends from the front end to approximately the rear end of the nozzle head 4, i.e. into the longitudinal region of end socket 21 or the associated end of the nozzle support 3 and which forms the distribution chamber 24, which is slightly wider than inlet opening 23. On the outer edge of the boundary of this depression engages in sealed manner the nozzle body 10 by means of its inner face over the entire circumference of said boundary, all the inner openings of all the discharge nozzles 9 of the associated nozzle units 6, 7, 8 being provided between the front and rear ends of said boundary. The furthest forward or outermost discharge nozzle 9 is appropriately together with further adjacent nozzles located immediately in the vicinity of the inlet opening 23, while at least one or two rear discharge nozzles 9 can be located behind the inlet opening 23 in the vicinity of the outer end of nozzle support 3, i.e. in the vicinity of bearing end 27.

The outer faces located between the nozzle bodies 10 of the nozzle head 4, which in the represented embodiment has approximately trochoidal external cross-sections, can be provided with longitudinal ribs or grooves to improve the grip.

By turning the particular nozzle head 4 about the control or adjusting axis 30 coinciding with the central axis of nozzle support 3 or parallel to the standing surface of base part 2 and crossing or intersecting at right angles the rotor axis 12, each of the nozzle units 6, 7, 8 can, as desired, be brought into at least one operating position, in which its inlet opening 23 is connected in the described manner to the passage opening 22 of water supply 17. In at least one of these continuously selectable operating positions between two end positions and in particular in all the operating positions, except for a single end position, the discharge nozzles 9 have a drive setting angle with respect to the rotor axis 12 such that when water passes out of the discharge nozzles 9 a driving rotational force acts on the rotor 11, which rotates the latter. For this purpose the central axes of the discharge nozzles 9 located on the top of nozzle head 4 in the operating position and located in a common axial plane 31, in a longitudinal view of the nozzle head are inclined with respect to the rotor axis 12 by a setting angle which in the central operating position is appropriately less than 30° or 20° and is preferably approximately 10°, so that setting angle can be continuously increased to approximately double, i.e. approximately 20°.

In one end position provided as an inoperative position the setting angle is zero, i.e. the axial plane 31 is parallel to or in the rotor axis 12. The central axes of the discharge nozzles 9 cross or intersect the control axis 30, i.e. the axial plane 31 coinciding with the median longitudinal plane of distribution chamber 24 and inlet opening 23 is also an axial plane of control axis 30 and in the central operating position coincides with the median longitudinal plane of passage opening 22.

To facilitate the setting of the nozzle head 4, a locking device 32 is provided, which is appropriately constructed in such a way that it must be noticeably overcome in both working end positions of nozzle unit 6, 7, 8 and for more easily finding the central operating position, it is also possible to provide for the latter an easily releasable, but still detectable locking means. In a simple embodiment on the outer circumference of nozzle support 3 is provided at least one projecting locking cam 33, with which is associated in the casing of nozzle head 4 or bearing end 27 a ring of locking openings 34, which are provided for setting the particular nozzle unit 6, 7, 8.

For example, for the two operating end positions of each nozzle unit 6, 7, 8, there can be two locking cams 33 reciprocally displaced in a corresponding arc angle and for each nozzle unit 6, 7, 8 only a single locking opening 34 is provided, which is preferably constructed as a break in the casing of the bearing end 27 and on whose outer circumference is covered by the associated end of nozzle body 10, so that no dirt penetration can take place despite simple manufacture.

Figure 4:
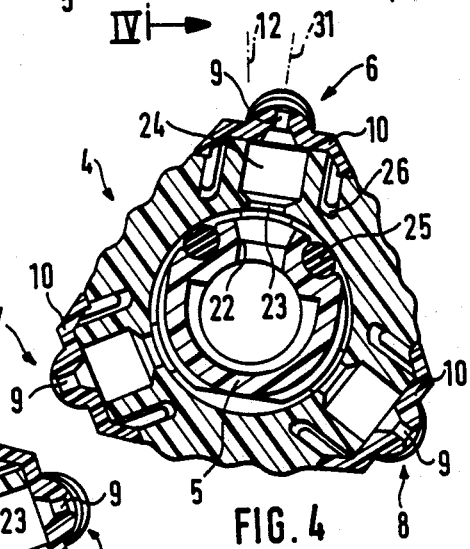
FIG. 4: A section along line IV—IV of FIG. 3.
Figure 5:
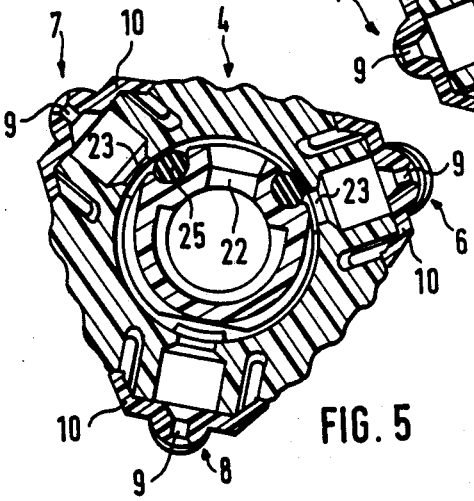
FIG. 5: The section according to FIG. 4, but in a different operating position.

As shown in FIGS. 4 and 5, the angular spacings between the inlet openings 23, as well as their widths with respect to the effective arc angle of seal 25 are so matched that the nozzle head 4 can be so adjusted in a central position between two central operating positions of two adjacent nozzle units 6, 7, 8, that the inlet openings 23 of said two adjacent nozzle units on either side are located outside the seal 25, i.e. all the nozzle units 6, 7, 8 of nozzle head 4 are cut off from the water supply 17 and no water can be discharged from any of the associated discharge nozzles 9. The multi-arm sprinkler can consequently be set to an operation, in which less than the total number of arms operate.

Figure 2:
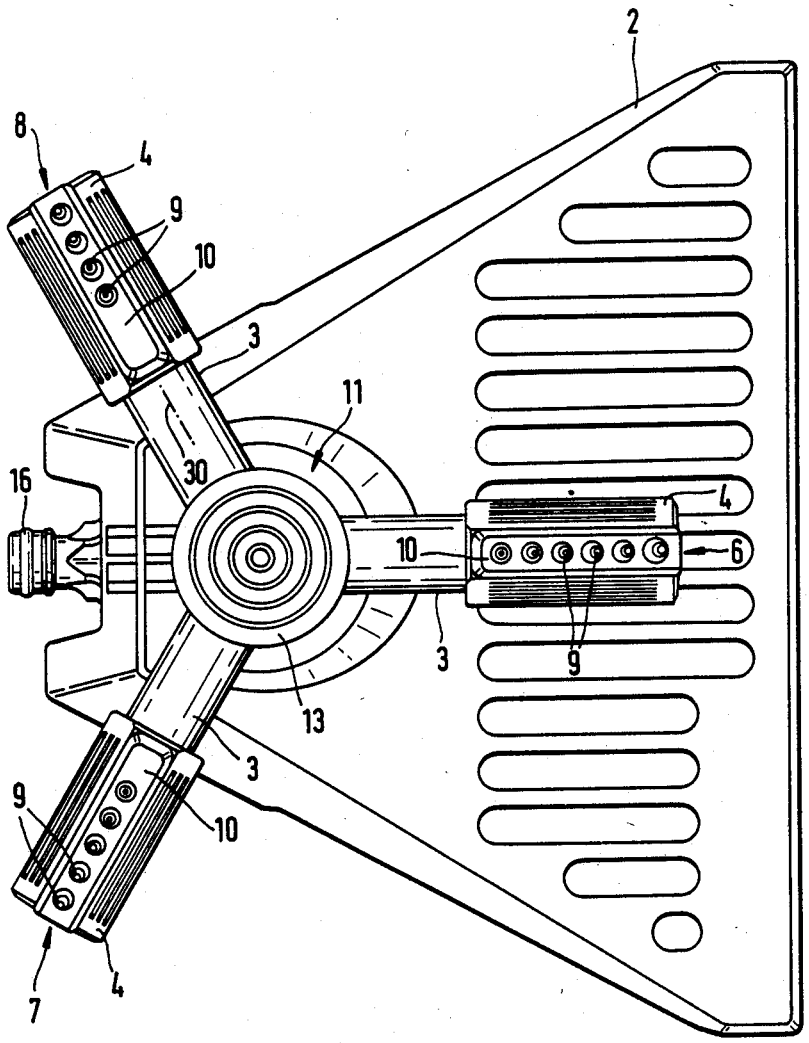
FIG. 2: The sprinkler according to FIG. 1 in plan view.
Figure 3:
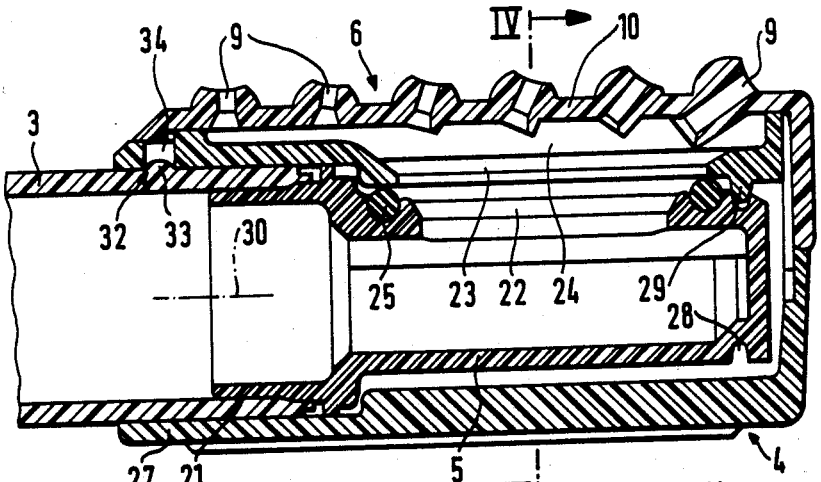
FIG. 3: A detail of FIG. 1 on a larger scale.

FIG. 2 shows three nozzle supports 3, in each case on a different nozzle unit 6 or 7 or 8 in the operating position. In each case one nozzle unit 6 of each nozzle head 4 has a maximum number of e.g. six nozzle openings 9 uniformly distributed over the length of the nozzle body 10, a further nozzle unit 7 has a number, reduced by at least one discharge nozzle and e.g. five nozzles 9 and finally the third nozzle unit 8 has a further reduced number, e.g. four discharge nozzles 9.

The control axes 30 in the side view according to FIG. 1 can also be at an angle to the rotor axis 12, e.g. such that they are downwardly or upwardly inclined with respect to the free ends of the nozzle arms. However, in all cases it is appropriate for the control axes 30 to be at right angles to the rotor axis 12.

We claim:

1. A sprinkler, comprising:

a base part;

at least two nozzle supports arranged on the base part for performing a sprinkler motion;

a separate nozzle head arranged on each of said nozzle supports;

a nozzle unit in the form of a jet driving unit, having at least one discharge nozzle provided on each said nozzle head, said nozzle unit being manually positionable with respect to the nozzle support into at least one operating position, defining a discharge position and a jet driving position, and being connected to a water supply, and wherein for each of at least two said nozzle supports are provided at least two separate, different nozzle units for selective operation, said nozzle units of said at least two nozzle supports providing independently adjustable jet driving units having an inoperative position and operative position.

2. The sprinkler according to claim 1, wherein said at least two nozzle units of each of at least two supports are provided on a common said nozzle head.

3. The sprinkler according to claim 1, wherein the nozzle units of each of at least two nozzle supports are independently rotatably arranged about separate adjusting axes between the inoperative position and at least one operating position.

4. The sprinkler according to claim 1, wherein the nozzle head of each of at least two nozzle supports is mounted on the nozzle support in the manner of a turret indexing head separately adjustable with respect to at least one further of said nozzle heads, in such a way that in each case at least one nozzle unit is in said inoperative position.

5. The sprinkler according to claim 1, wherein each of said nozzle units of at least two separately adjustable nozzle heads is constructed as a jet driving unit for the sprinkler.

6. The sprinkler according to claim 1, wherein said at least two nozzle supports are mounted rotatably about a rotor axis, nozzle heads of said nozzle supports being independently adjustable into said jet driving positions.

7. The sprinkler according to claim 1, wherein said at least two nozzle units are different than one another in characteristics including at least one of a number, size and angular positioning of associated ones of the discharge nozzles.

8. The sprinkler according to claim 1, wherein the discharge nozzles of at least one nozzle unit are located in a row.

9. The sprinkler according to claim 1, wherein axes defined by the discharge nozzles of at least one nozzle unit are located substantially in a common axial plane.

10. The sprinkler according to claim 4, wherein the discharge nozzles of at least one nozzle unit are located substantially in an axial plane of the adjusting axis.

11. The sprinkler according to claim 1, wherein at least one nozzle unit is formed by a separate substantially ledge-like nozzle body, fixed to said nozzle head and having a plurality of nozzles.

12. The sprinkler according to claim 11, wherein all the separate nozzle bodies of said nozzle head are circumferentially distributed on a head casing and are inserted in identically constructed receptacles of a jacket of said nozzle head.

13. The sprinkler according to claim 1, wherein independently of at least one further of said nozzle units at least one nozzle unit is adjustable about an adjusting axis in several different discharge and jet driving positions with respect to said nozzle support.

14. The sprinkler according to claim 1, wherein independently of at least one further of said nozzle units, at least one said nozzle unit is provided with a central discharge and jet driving position defining a drive inclination, a discharge but non-driving position being provided for said at least one nozzle unit apart from said central discharge and jet driving position.

15. The sprinkler according to claim 1, wherein for at least two said nozzle heads, in a water supply to at least one nozzle unit is provided a closing valve, closing valves of the at least two nozzle heads being independently adjustable.

16. The sprinkler according to claim 15, wherein the closing valves are constructed in the manner of sliding valves.

17. The sprinkler according to claim 15, wherein the closing valves of the at least two said nozzle heads are independently opened and at least partly closed as a function of position of the associated nozzle unit.

18. The sprinkler according to claim 1, wherein the nozzle support has a tubular supply shaft for the nozzle head with a water passage opening communicating with the nozzle unit in the operating position, said supply shaft having a free end and a fixing end attached to said nozzle support, said supply shaft defining an extension of an end of said nozzle support.

19. The sprinkler according to claim 18, wherein the nozzle head is mounted on said end of said nozzle support, said supply shaft being hollow and having a freely projecting closed end and a jacket traversed by said passage opening, said nozzle head having for at least one nozzle unit a distribution chamber formed by an external depression, of which in a central discharge and jet driving position an inlet opening is substantially congruently connected to said passage opening, the passage opening being surrounded by a seal.

20. The sprinkler according to claim 1, wherein for at least one operating position of each of at least two separately controllable nozzle units is provided a resilient locking means.

21. The sprinkler according to claim 1, further comprising a locking means for at least one operating position of at least one nozzle unit, formed by at least one locking cam on an outer circumference of said nozzle support, with locking openings being formed in a jacket of the nozzle head, the jacket being cap-shaped.

22. The sprinkler according to claim 21, wherein at least one locking opening is by a nozzle body of said nozzle head.

23. The sprinkler according to claim 1, wherein the nozzle units of each of at least two nozzle supports are independently positionable arranged in a substantially horizontal mounting support.

24. The sprinkler according to claim 3, wherein each of said adjusting axes is at right angles to a rotor axis of the sprinkler and is substantially horizontal.

25. The sprinkler according to claim 1, wherein said nozzle supports are identical.

26. The sprinkler according to claim 6, wherein at least one nozzle support is formed by a tubular nozzle arm projecting radially from the rotor axis and is located on a central rotor hub of the sprinkler.

27. The sprinkler according to claim 11, wherein at least one of said nozzle bodies is positioned at an opening in the supply shaft.

28. The sprinkler according to claim 11, wherein at least one of said nozzle bodies is fixed in a replaceable manner.

29. The sprinkler according to claim 12, wherein at least one of said nozzle units is attached to a jacket of said nozzle head by a snap connection.

30. The sprinkler according to claim 11, wherein at least one of the nozzle bodies has profile legs with connector links engaging in slot-like receptacles in said nozzle head.

31. The sprinkler according to claim 18, wherein said supply shaft is enclosed by said nozzle head in substantially contact-free manner over most of said length extension of said supply shaft.

32. The sprinkler according to claim 18, wherein in the vicinity of said free end said supply shaft and said nozzle head engage each other by an single locking mounting.

33. The sprinkler according to claim 18, wherein said passage opening is elongated and surrounded by a seal arranged on said supply shaft, said nozzle head engaging said seal.

34. The sprinkler according to claim 18, wherein said supply shaft adjustably engages said nozzle support.

35. The sprinkler according to claim 18, wherein said fixing end of said supply shaft forms an end socket inserted into said end of said nozzle support.

36. The sprinkler according to claim 19, wherein said distribution chamber extends over said longitudinal extension of said end of said nozzle support.

* * * * *

UNITED STATES PATENT AND TRADEMARK OFFICE

CERTIFICATE OF CORRECTION

PATENT NO. : 4,905,903

DATED : March 6, 1990

INVENTOR(S) : Katzer et al.

It is certified that error appears in the above-identified patent and that said Letters Patent is hereby corrected as shown below: Title page:

In the Abstract, line 1, insert -- sprinkler (1) on a-- after "A".

Claim 22, column 9, line 6, insert --enclosed-- after "is".

Claim 36, column 10, line 26, delete "longitudinal".

Signed and Sealed this

Ninth Day of April, 1991

*Attest:*

*Attesting Officer*

HARRY F. MANBECK, JR.

*Commissioner of Patents and Trademarks*